US010829323B2

(12) United States Patent
Gleichauf et al.

(10) Patent No.: US 10,829,323 B2
(45) Date of Patent: Nov. 10, 2020

(54) MEDIA DRAWER FOR A MEDIA PROCESSING DEVICE AND MEDIA PROCESSING DEVICE

(71) Applicant: BDT Media Automation GmbH, Rottweil (DE)

(72) Inventors: Markus Gleichauf, Blumberg (DE); Marc Steinhilber, Rottweil (DE)

(73) Assignee: BDT Media Automation GmbH, Rottweil (DE)

( * ) Notice: Subject to any disclaimer, the term of this patent is extended or adjusted under 35 U.S.C. 154(b) by 73 days.

(21) Appl. No.: 16/263,928

(22) Filed: Jan. 31, 2019

(65) Prior Publication Data

US 2019/0233228 A1 Aug. 1, 2019

(30) Foreign Application Priority Data

Jan. 31, 2018 (DE) ..... 10 2018 102 182

(51) Int. Cl.
*B65H 1/26* (2006.01)
*B65H 1/02* (2006.01)
(Continued)

(52) U.S. Cl.
CPC ..... *B65H 1/266* (2013.01); *B65H 1/025* (2013.01); *B65H 1/04* (2013.01); *B65H 1/14* (2013.01); *B65H 2301/42252* (2013.01); *B65H 2402/30* (2013.01); *B65H 2405/15* (2013.01); *B65H 2555/40* (2013.01); *B65H 2801/06* (2013.01); *G03G 2215/00983* (2013.01)

(58) Field of Classification Search
CPC .... B65H 2555/40; B65H 1/266; B65H 1/027; B65H 1/025; B65H 1/04; B65H 1/14;
(Continued)

(56) References Cited

U.S. PATENT DOCUMENTS 5,661,309 A * 8/1997 Jeromin ..... G03G 15/758 250/370.09
5,850,243 A * 12/1998 Kinoshita ..... B41J 2/01 347/108
(Continued)

FOREIGN PATENT DOCUMENTS

DE 10000591 11/2000
JP 60012429 A * 1/1985 ..... B65H 3/0669

OTHER PUBLICATIONS

German Patent Office Search Report dated Oct. 24, 2018 categorizing references as a references.

*Primary Examiner* — Jeremy R Severson
(74) *Attorney, Agent, or Firm* — Akerman LLP; Peter A. Chiabotti

(57) ABSTRACT

The application relates to a media drawer for a media processing device with a housing and an electrically-driven lift table arranged in the housing, where the media drawer is movable between a first position, in which the media drawer is arranged in the media processing device in such a manner that media can be removed from the media drawer by the media processing device, and a second position, in which media can be inserted into the media drawer, where the lift table can be supplied with power in the first position by the power supply of the media processing device. Further, the media drawer can exhibit a power supply that is independent of the power supply of the media processing device, via which the lift table can be provided with power in the second position.

10 Claims, 7 Drawing Sheets

(51) Int. Cl.
*B65H 1/04* (2006.01)
*B65H 1/14* (2006.01)

(58) Field of Classification Search
CPC ..... B65H 2405/15; B65H 2402/30; B65H 2801/06; B65H 2301/42252; B65H 2405/114; G03G 2215/00978; G03G 2215/00983; G03G 15/5004; G03G 15/80
See application file for complete search history.

(56) References Cited

U.S. PATENT DOCUMENTS

| | | | | |
|---|---|---|---|---|
| 6,055,062 | A * | 4/2000 | Dina | G03G 15/80 358/1.12 |
| 6,267,522 | B1 | 7/2001 | Slippy et al. | |
| 6,983,469 | B2 | 1/2006 | Steinhilber | |
| 7,296,791 | B2 * | 11/2007 | Kurahashi | B42C 19/02 271/176 |
| 7,684,723 | B2 * | 3/2010 | Kikuchi | G03G 15/5004 399/82 |
| 7,768,739 | B2 | 8/2010 | Starr et al. | |
| 7,800,860 | B2 | 9/2010 | Steinhilber | |
| 9,309,065 | B2 | 4/2016 | Brown et al. | |
| 9,561,920 | B1 | 2/2017 | Wilsher et al. | |
| 10,133,291 | B2 * | 11/2018 | Ohhashi | B41J 29/393 |
| 2008/0237968 | A1 | 10/2008 | Suzuki | |
| 2013/0080713 | A1 | 3/2013 | Steinhilber | |
| 2019/0291477 | A1 * | 9/2019 | Oguchi | B65H 5/062 |

* cited by examiner

MEDIA DRAWER FOR A MEDIA PROCESSING DEVICE AND MEDIA PROCESSING DEVICE

CROSS REFERENCE TO RELATED APPLICATIONS

This application claims priority to German Patent Application No. DE 10 2018 102 182.8 filed Jan. 31, 2018, the entirety of which is incorporated by reference.

BACKGROUND

The application relates to a media drawer for a media processing device, as well as a media processing device with a media drawer.

Media processing devices are known, such as, for example, printers, print machines or media feeding devices, in which the media to be processed is inserted as a pile into a compartment, in particular, a compartment of a drawer, in order to be able to individually feed them from this pile to the media processing device. When media is inserted into the drawer, the drawer must generally be moved from a first position, in which it is arranged in the media processing device, into a second position. The media can subsequently be refilled and the drawer once again moved into the first position. Generally, the media processing device is at a standstill during this time.

Known compartments for media processing devices exhibit an electrically-driven lift table, with which upon removal of individual media from the supply pile, the diminishing pile of the compartment can be reset, so that the position from which the uppermost media is taken from the compartment remains the same. During the filling process, the media must be inserted as a pile into the compartment, wherein the lift table is arranged in a lowered position, which is often not terribly ergonomic. In the case of known media drawers, the electrically-driven lift table is supplied with power by means of the power supply of the media processing device, when the media drawer is inserted into the media processing device.

SUMMARY

The application is directed to a media drawer for a media processing device in such a manner that it is designed in a user-friendly manner.

Advantageous embodiments and further developments are described herein.

The media drawer for a media processing device can have a housing and an electrically-driven lift table arranged in the housing, wherein the media drawer is movable between a first position, in which it is arranged in such a manner in the media processing device that media is removable from it by the media processing device, and a second position, in which media can be inserted into the media drawer, wherein the lift table in the first position can be supplied with power by the power supply of the media processing device, is distinguished in that the media drawer exhibits a power supply that is independent of the power supply of the media processing device, by means of which the lift table can be supplied with power in the second position.

The subject matter of the application is based upon the provision in the media drawer of a power supply that is independent of the power supply of the media processing device, by means of which the lift table can be supplied with power in the second position. In this way, it is possible to also electrically drive the lift table in the second position, whereby the filling with media on the lift table is simplified.

Advantageously, the media drawer exhibits a toggle switch, which in the first position of the media drawer connects the lift table to the power supply of the media processing device and in the second position connects the lift table to the power supply that is independent of the power supply of the media processing device, which can simplify use.

Advantageously, the independent power supply exhibits at least one battery, inasmuch as batteries can, in a particular simple manner, provide power independent of a fixed power supply system.

A preferred further development provides that the independent power supply can be switched on and off by means of an operation element that is arranged on the media drawer, this to enable a user-friendly use.

The lift table can advantageously be driven to a height of up to 500 mm, in order to be able to provide a sufficient supply amount of media.

According to a particularly preferred further development, the media drawer exhibits rollers, in order to be able to pull the media drawer out of the media processing device in a simple manner and, where desired, to fully remove it from the media processing device and, for example, to be able to exchange it against a second media drawer. It is thereby possible to significantly shorten the refill time when the second media drawer filled with media is already provided, when the empty media drawer is pulled out of the media processing device.

A media processing device can exhibit a media drawer.

The media drawer exhibits a contact element in a preferred embodiment, which in the first position contacts a contact element arranged on the media processing device, wherein an electrically conductive connection is established by means of the two contact elements between the power supply of the media processing device and the lift table, in such a way that operation can be simplified.

A preferable further development of the media processing device provides that at least one guide rod is exhibited and at least one guide roller is provided between the media processing device and the media drawer, which interact with the guide rod during movement of the media drawer between the first position and the second position. Through use of such a guide device, a simple insertion of the media drawer into the media processing device, and preferably also a simplified orientation of the media drawer in the media processing device, is enabled.

The media processing device is advantageously a printer, print machine or media feeding device or similar or components thereof.

BRIEF DESCRIPTION OF THE DRAWINGS

The application is elucidated in detail on the basis of the following figures.

FIGS. 1 through 5, as well as 10 and 11 show various views of a first embodiment of a media processing device 10 with a media drawer 20. The media processing device 10 can be a printer, print machine, media feeder device or similar or a component thereof and can exhibit a device for the removal of a single medium, in particular, the uppermost medium, from the media drawer. The media processing device 10 exhibits a power supply. The media processing device 10 can, for example, be connected to a fixed power supply system by means of a cable 11 with a plug 12, wherein the power supply can be formed by the media processing device 10 (Cf. 10). The media processing device 10 can exhibit a control unit 15.

In FIG. 1, the media drawer 20 is inserted into the media processing device 10 and, in particular, is in a first position. In FIGS. 2 and 3, the media drawer 20 is pulled out of the media processing device 10, in particular, completely removed from the same, and, in particular, is in a second position.

Figure 1:
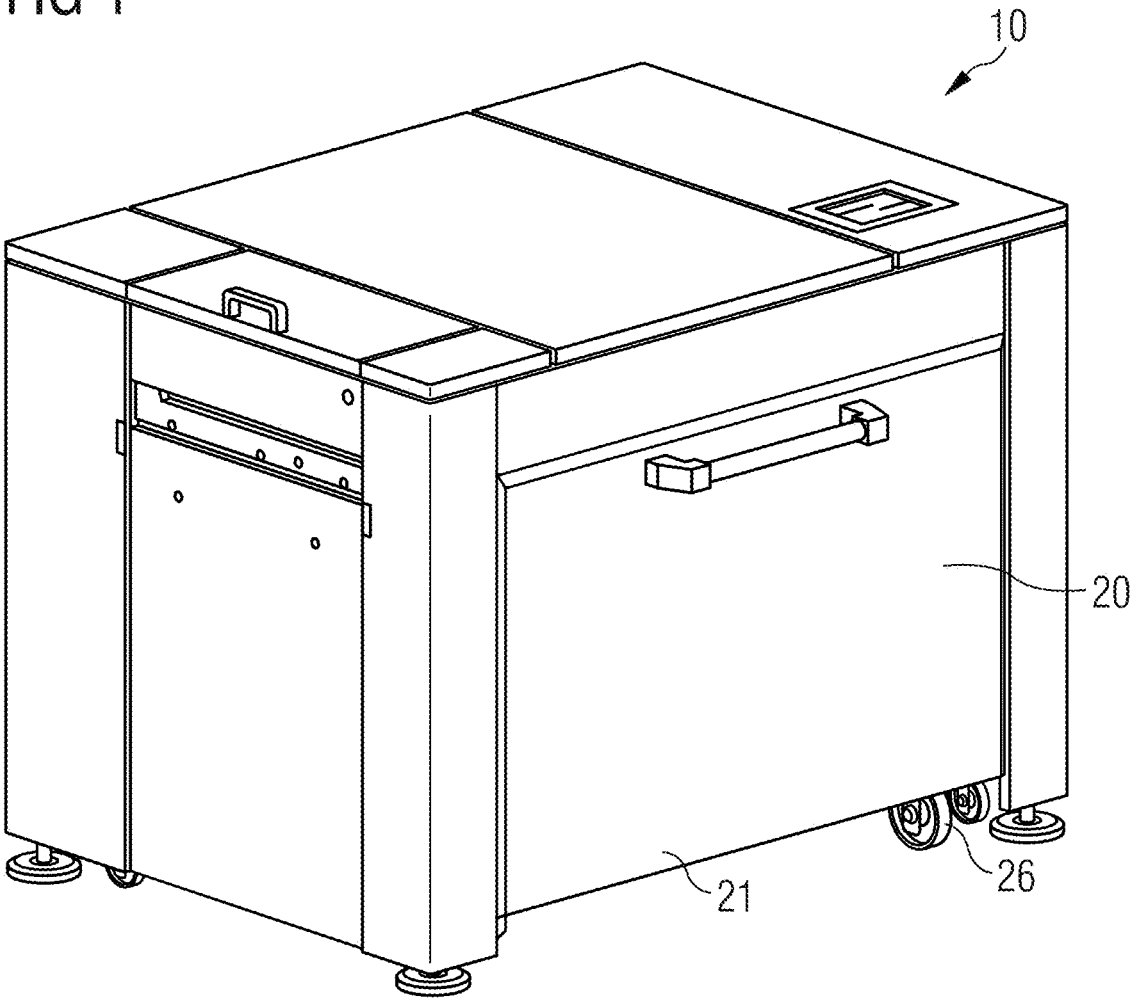
FIG. 1 shows a perspective view of a first embodiment of a media processing device with a media drawer, wherein the media drawer is inserted into the media processing device.

The media drawer 20 exhibits a housing 20*a* with a front side 21, a back side 22 that lies opposite to the front side 21, two side surfaces 23, 24 which link the front side 21 with the back side 22 and a bottom surface 25 and is preferably designed to be open towards the top, which is to say that the side that lays opposite to the bottom surface 25 is open. On the bottom side of the bottom surface 25, in one embodiment, there are arranged multiple, for example, four, rollers 26, which allow the media drawer 20 to displace. A grip 27 can be arranged on the front side 21, which can be used to pull out the media drawer 20 from the media processing device 10.

An electrically-driven lift table 30 is arranged in the media drawer 20, upon which at least one pile of media can be laid. Media can be flat, flexible objects made up of various materials, for example, made of paper, plastic, wood or metal, in particular, sheets of paper, in various formats and various thicknesses. To be able to adapt the media drawer 20 to various formats of the media, there is at least one, for example, two or four installation elements 28, arranged on the bottom surface 25. The installation elements 28 can be designed to be positionally displaceable and can be positioned in such a manner that they are laterally abutting a pile of media. In particular, the installation elements 28 can penetrate the lift table 30 through slits 31, to also enable the laying out of a pile of media arranged on the lift table 30 in the case of movement of the lift table 30.

Figure 2:
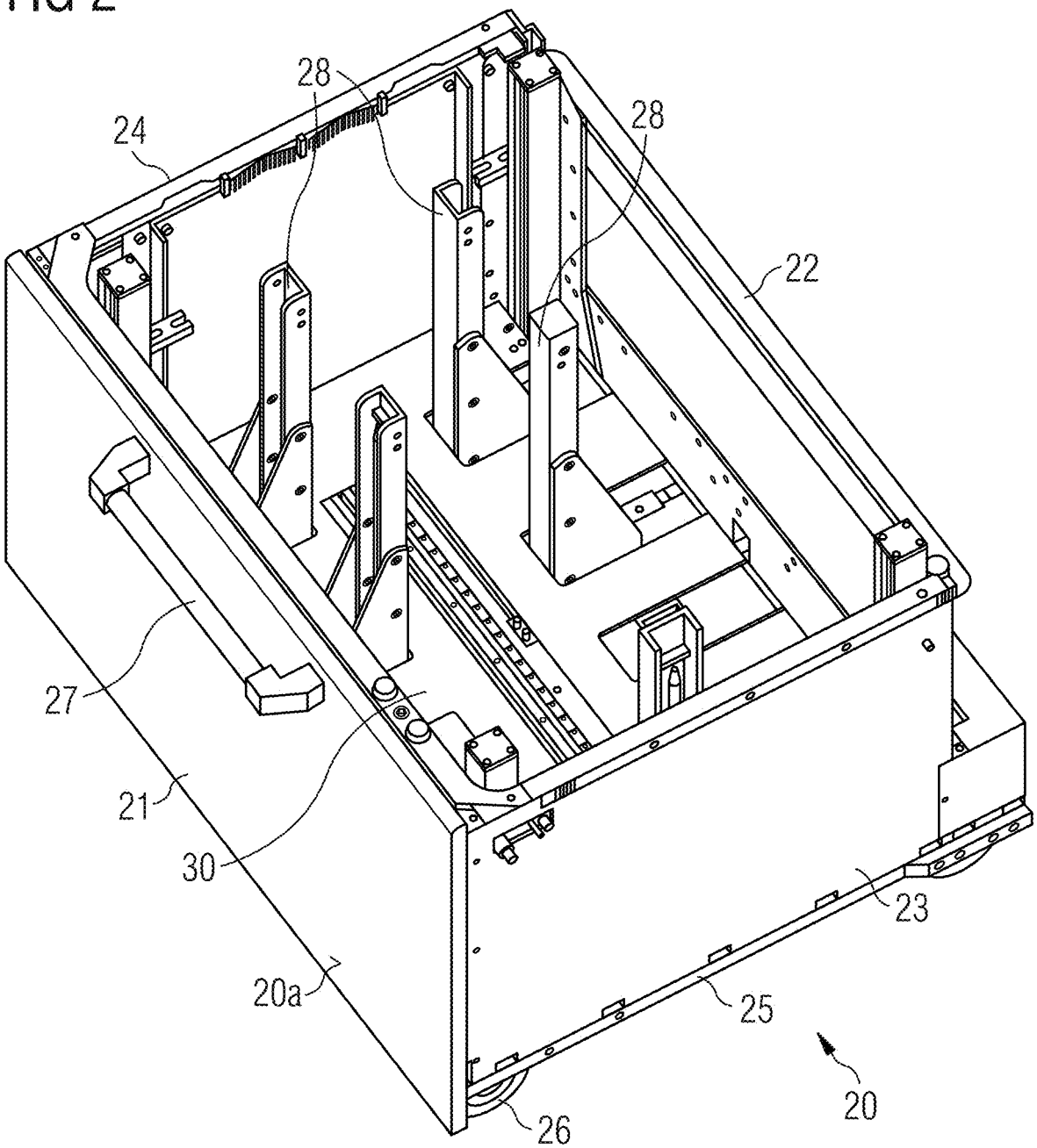
FIG. 2 shows a perspective view of the media drawer according to FIG. 1, which has been pulled out of the media processing device, with lowered lift table.
Figure 3:
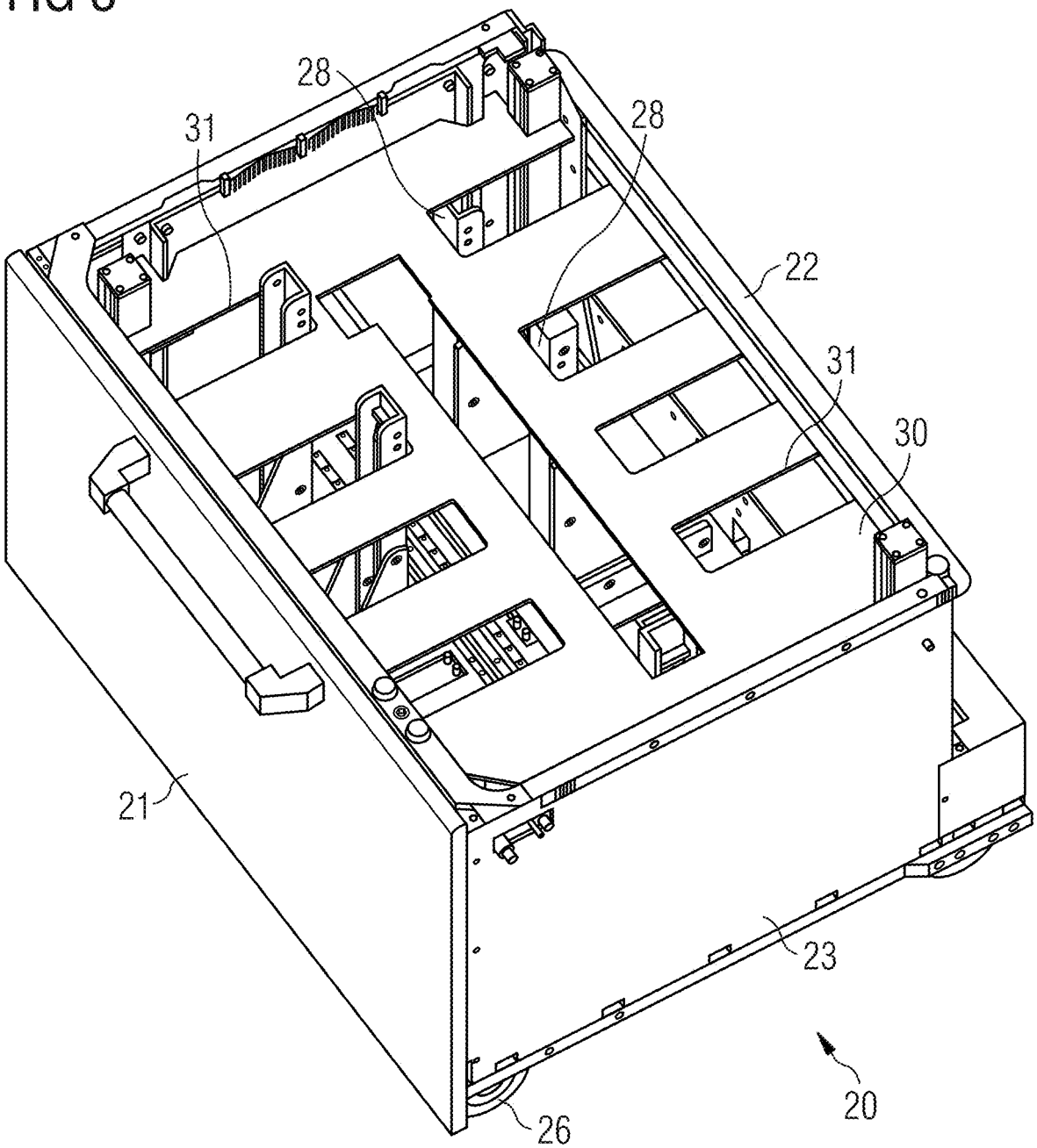
FIG. 3 shows the media drawer according to FIG. 2 with lowered lift table.

FIG. 2 shows the lift table 30 in a lower position, whereas FIG. 3 represents the lift table 30 in a raised position. Preferably the lift table 30 can be driven up to a height of up to 500 mm, to be able to supply correspondingly large piles of media and to be able to reset the height of the lift table 30 in such a manner, upon removal of media, that the uppermost medium of the pile of media is arranged at a constant height, to enable the removal of media independently of the height of the pile of media. The lift table 30 can be controlled by means of a control unit 29, which is arranged in the media drawer 20.

When the media drawer 20 is inserted into the media processing device 10 and is in the first position (Cf. FIG. 1), the lift table is supplied with power by means of the power supply of the media processing device. On top of this, in particular, an electrical contact element 70 of the media drawer 20 in the first position comes in electrically conductive contact with a contact element 71 that is arranged on the media processing device 10, in such a manner that an electrically conductive connection is established between the media processing device 10 and the media drawer 20 and the lift table, in particular, a motor to drive the lift table, to which the power supply of the media processing device 10 is connected (Cf., in particular, FIG. 11).

Figure 5:
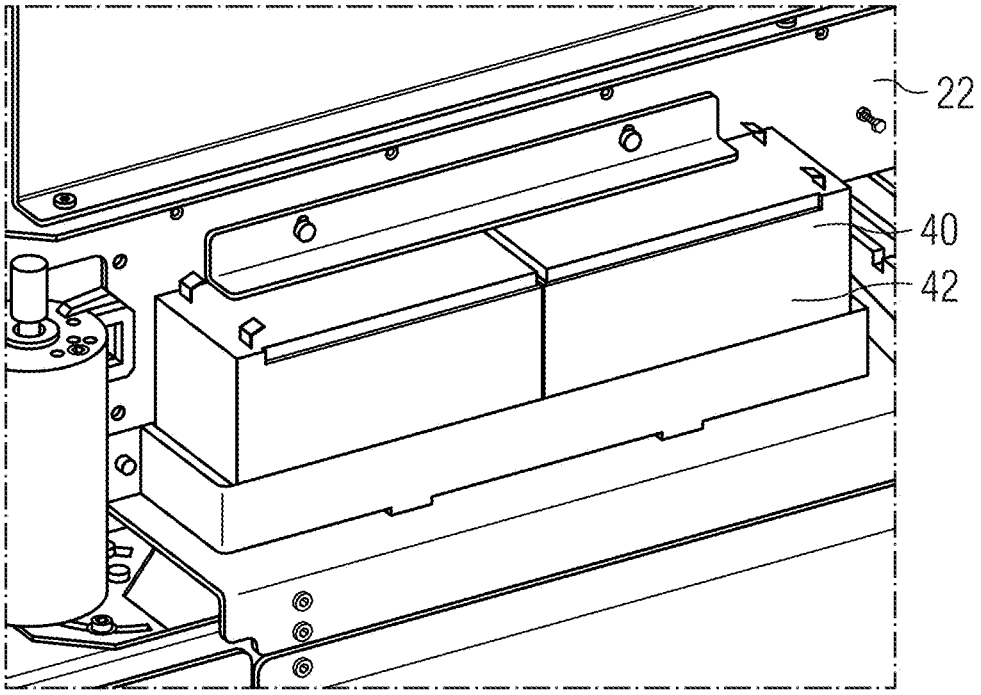
FIG. 5 shows a detail from a view on the back side of the media drawer according to FIG. 2 with sight of the independent power supply.
Figure 6:
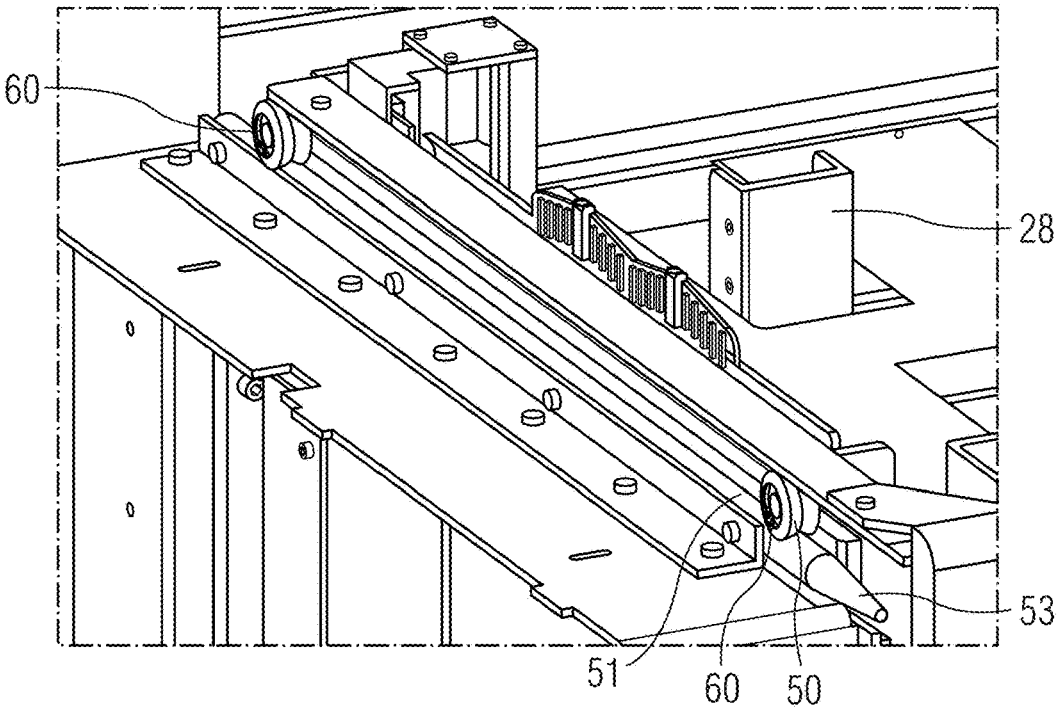
FIG. 6 shows a detailed view of a further embodiment of a media processing device with a media drawer and a guide device between the media processing device and the media drawer, wherein the media drawer is arranged in a first position.
Figure 7:
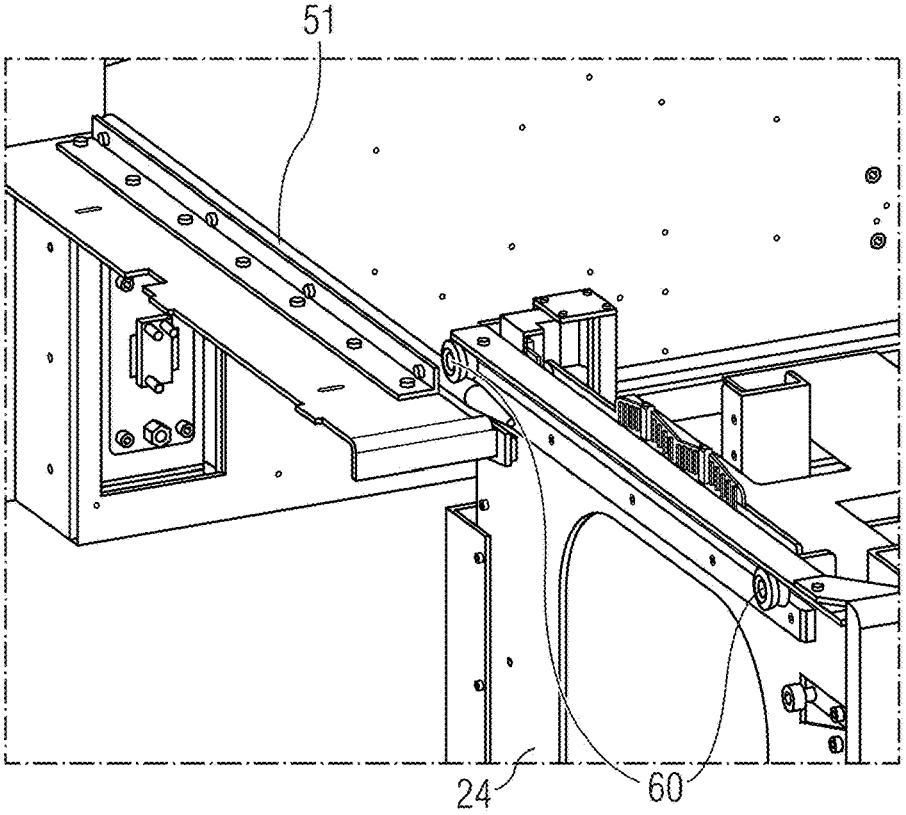
FIG. 7 shows the view according to FIG. 6, in which the media drawer is arranged in a second position.
Figure 8:
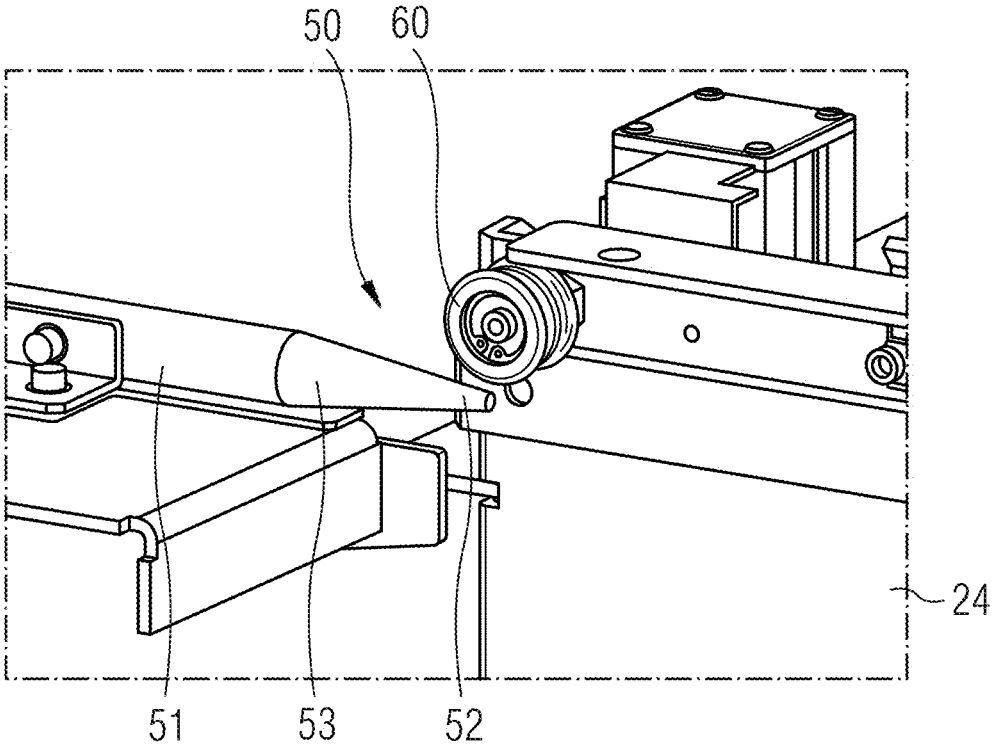
FIG. 8 shows a detailed view of the interaction of the guide arrangement between the media drawer and the media processing device during the insertion of the media drawer into the media processing device.
Figure 9:
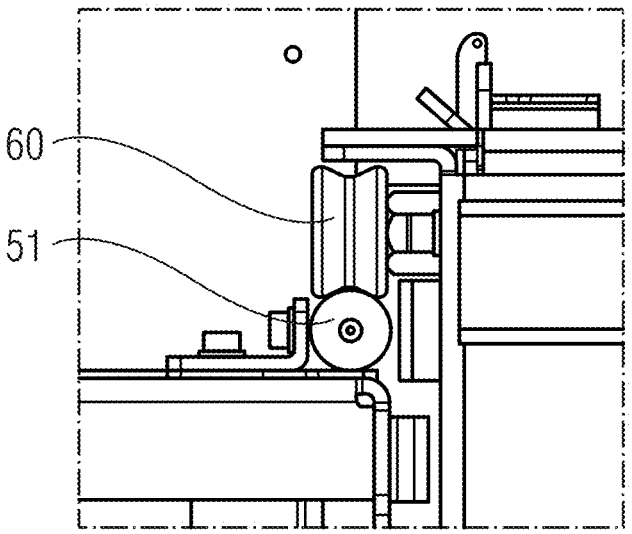
FIG. 9 shows a detailed view of the interaction of the guide device between the media processing device and the media drawer with the media drawer in the first position.
Figure 10:
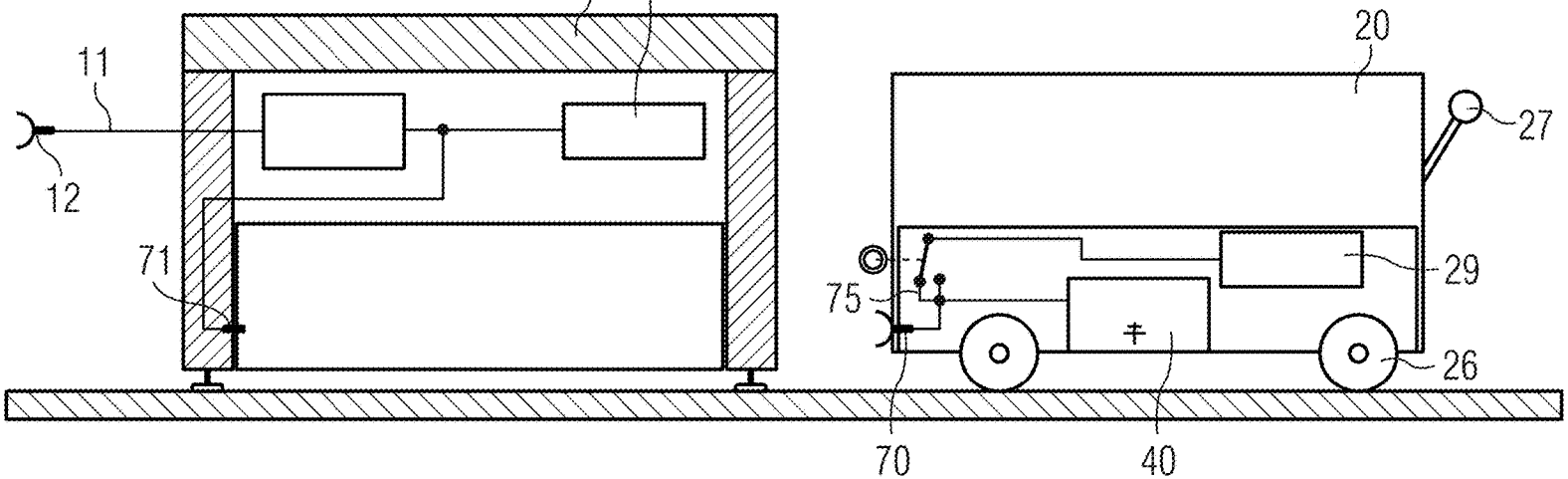
FIG. 10 shows a schematic sectional representation of the media processing device according to FIG. 1, wherein the media drawer is pulled out of the media processing device in a second position.
Figure 11:
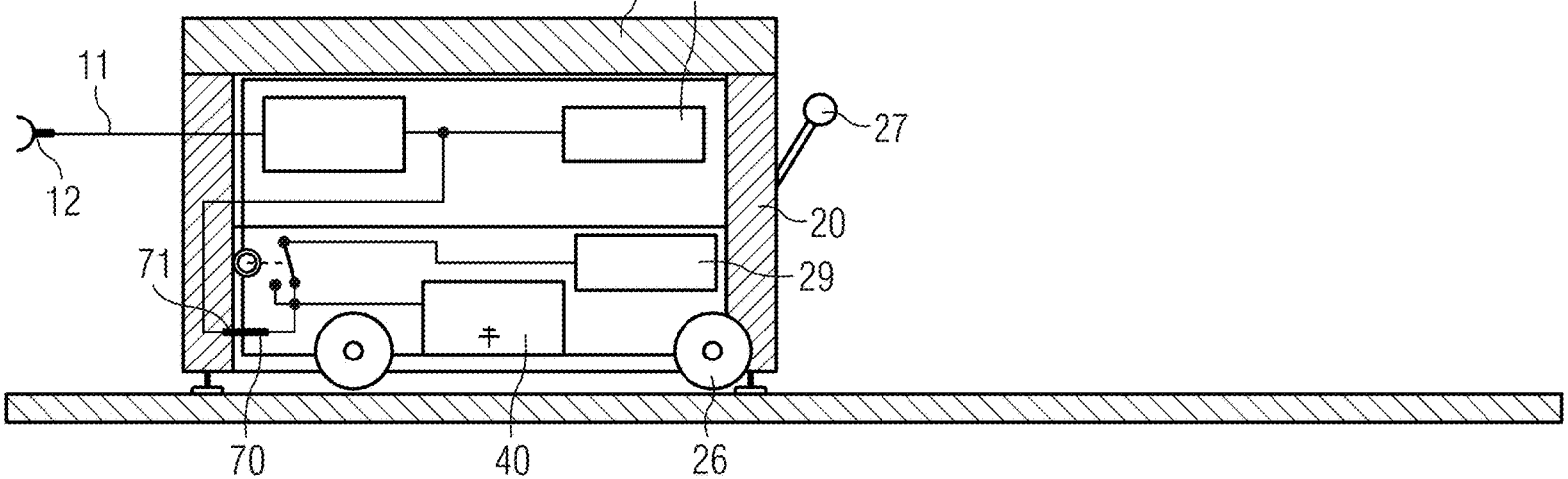
FIG. 11 shows a schematic sectional representation of the media processing device according to FIG. 1, wherein the media drawer is inserted into the media processing device in the first position.

The media drawer 20 exhibits a power supply 40 that is independent of the power supply of the media processing device 10, by means of which the lift table 30 can be supplied with power in the second position, in which the media drawer 20 is pulled out of the media processing device 10 and the electrically conductive contact between the media processing device 10 and the media drawer 20 is thereby interrupted (Cf., in particular, FIGS. 10 and 11). The power supply 40 of the media drawer 20 exhibits, in particular, one or multiple batteries 42, which can, for example, be arranged on the back side 22 of the media drawer 20 (Cf. FIG. 5). If the electrically conductive connection between the media processing device 10 and media drawer 20 is interrupted, then an electrically-conductive contact is simultaneously established between the lift table 30, in particular, the motor of the lift table 30, and the power supply 40, for example, by means of a toggle switch 75. It is thereby also possible to drive the lift table 30 in the second position. On top of this, the control unit 29 of the media drawer is also, in particular, connected to the power supply 40.

Figure 4:
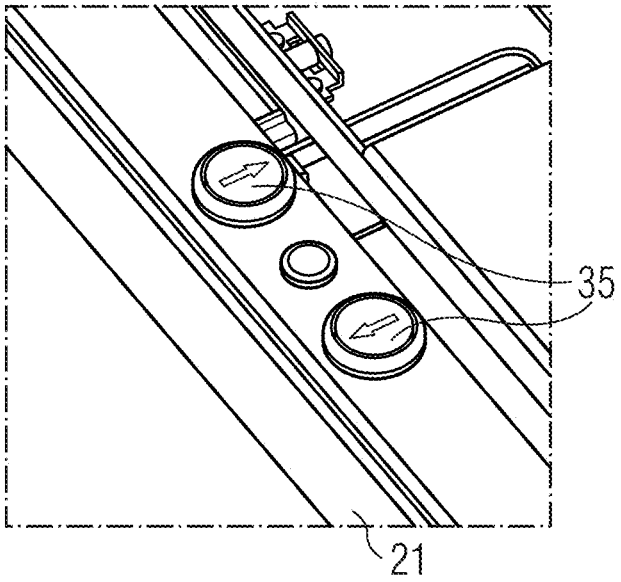
FIG. 4 shows a detail enlargement from FIG. 2.

In particular, an operation element 35, with which the lift table 30 can be raised or lowered (Cf., in particular, FIG. 4), can be arranged on the media drawer 20 for the driving of the lift table 30. The operation element 35 can, for example, exhibit two push buttons, one for a raising movement and one for a lowering movement, as represented in FIG. 4. Alternatively, the operation element 35 can also be designed as a flip switch, a rocker switch, a rotary switch or similar. The independent power supply 40 on the lift table 30 initially enables the raising of the lift table 30 for the filling of the media drawer 20, to better be able to ergonomically lay out the insertion of the media, and subsequently lower the lift table 30. To further shorten the stoppage time of the media processing device 10, it is always possible to provide two or more media drawers 20, and insert an already-prefilled media drawer 20 directly into the media processing device 10, as soon as the empty media drawer 20 has been removed from the media processing device 10.

The FIGS. 6 through 9 show details from various views of a second embodiment of a media drawer 20 for a media processing device 10, which in principle correspond with the media processing device 10 and the media drawer 20 represented in the FIGS. 1 through 5 and additionally exhibits a guide device 50 between the media processing device 10 and the media drawer 20. The guide device 50 exhibits at least one guide rod 51 and at least one guide roller 60, wherein the guide rod 51 is, for example, arranged on the media processing device 10 and the guide roller 60 is, for example, arranged on the media drawer 20. The guide rod 51 can exhibit a tapered section 53 on one free end 52. The guide roller 60 is designed in such a manner that it can roll along the guide rod 51. A guide device 50 of this type simplifies the insertion of the media drawer 20 into the media processing device 10, in particular, when two guide rods 51 are arranged on the media processing device 10 and at least one, in particular, respectively two guide rollers 60 are arranged on both side surfaces 23, 24 of the media drawer 20, since in the feeding of the media drawer 20 the media processing device 10 is aligned with the media drawer 20 between the two guide rods 51 and is guided by means of the guide rods 51 into the desired position relative to the media processing device 10.

LIST OF REFERENCE SIGNS

10 Media processing device
11 Cable
12 Plug
15 Control unit
20 Media drawer
20*a* Housing
21 Front side
22 Back side
23 Side surface
24 Side surface
25 Bottom surface
26 Roller
27 Grip
28 Installation element
29 Control unit
30 Lift table
31 Slit
35 Operation element
40 Power supply
42 Battery
50 Guide device
51 Guide rod
52 Free end
53 Section
58 Operation element
60 Guide roller
70 Contact element
71 Contact element
75 Toggle switch

We claim:

1. A media drawer for a media processing device, comprising:
a media drawer housing;
an electrically-driven lift table arranged in the media drawer housing, wherein the media drawer is movable between a first position in which the media drawer is arranged in the media processing device in such a manner that media can be removed from the media drawer by the media processing device, and a second position, in which media can be inserted into the media drawer;
wherein the lift table is supplied with power in the first position by a power supply of the media processing device;
wherein the media drawer further comprises an independent power supply that is independent of the power supply of the media processing device; and
wherein the independent power supply provides power to the lift table when the media drawer is in the second position.

2. The media drawer according to claim 1, further comprising a toggle switch, which in the first position of the media drawer connects the lift table to the power supply of the media processing device and in the second position connects the lift table to the independent power supply.

3. The media drawer according to claim 1, wherein the independent power supply comprises a battery.

4. The media drawer according to claim 1, wherein the independent power supply is switchable on and off by a button arranged on the media drawer.

5. The media drawer according to claim 1, wherein the lift table can be driven to a height of up to 500 mm.

6. The media drawer according to claim 1, wherein the media drawer comprises rollers.

7. A media system, comprising:
a media processing device arranged to receive a media drawer;
a media drawer, wherein the media drawer comprises:
a media drawer housing;
an electrically-driven lift table arranged in the media drawer housing, wherein the media drawer is movable between a first position, in which the media drawer is arranged in the media processing device in such a manner that media can be removed from the media drawer by the media processing device, and a second position, in which media can be inserted into the media drawer;
wherein the lift table is supplied with power in the first position by a power supply of the media processing device;
wherein the media drawer further comprises an independent power supply that is independent of the power supply of the media processing device; and
wherein the independent power supply provides power to the lift table when the media drawer is in the second position.

8. The media system according to claim 7,
wherein the media drawer comprises a media drawer contact element;
wherein the media processing device comprises a media processing contact element;
wherein when the media drawer is in the first position, the media drawer contact element contacts the media processing contact element;
wherein an electrically conductive connection between the power supply of the media processing device and the lift table is established by the media processing contact element and the media drawer contact element.

9. The media system according to claim 7, wherein the media processing device further comprises:
a guide rod; and
a guide roller;
wherein the guide rod and the guide roller are located between the media processing device and the media drawer and the guide roller interacts with the guide rod during movement of the media drawer between the first position and the second position.

10. The media system according to claim 7, wherein the media processing device is a printer, printing machine, media feeding device or a combination thereof.

* * * * *